US011213143B2

(12) United States Patent
Sidwell

(10) Patent No.: US 11,213,143 B2
(45) Date of Patent: Jan. 4, 2022

(54) FURNITURE BLANKET ASSEMBLY

(71) Applicant: Dorian Sidwell, Covington, GA (US)

(72) Inventor: Dorian Sidwell, Covington, GA (US)

( * ) Notice: Subject to any disclaimer, the term of this patent is extended or adjusted under 35 U.S.C. 154(b) by 0 days.

(21) Appl. No.: 16/050,454

(22) Filed: Jul. 31, 2018

(65) Prior Publication Data

US 2020/0037794 A1 Feb. 6, 2020

(51) Int. Cl.

| | |
|---|---|
| ***A47G 9/08*** | (2006.01) |
| ***A47G 9/06*** | (2006.01) |
| ***A47G 9/02*** | (2006.01) |

(52) U.S. Cl.

CPC ..... *A47G 9/066* (2013.01); *A47G 9/0223* (2013.01)

(58) Field of Classification Search

CPC ..... A47G 9/08; A47G 9/06
USPC ..... 5/484, 482, 496, 498
See application file for complete search history.

(56) References Cited

U.S. PATENT DOCUMENTS

| | | | | |
|---|---|---|---|---|
| 4,753,483 | A * | 6/1988 | Beier | A47C 7/748 2/69.5 |
| 6,408,462 | B1 | 6/2002 | Moore | |
| 6,851,127 | B1 | 2/2005 | Khan | |
| 7,513,001 | B1 | 4/2009 | Leach | |
| 2005/0034234 | A1 | 2/2005 | Bellick | |
| 2011/0067163 | A1 | 3/2011 | Sprole | |

* cited by examiner

*Primary Examiner* — Frederick C Conley

(57) ABSTRACT

A furniture blanket assembly for covering one or more users sitting on or adjacent to an article of furniture includes a cover that is comprised of a deformable material and the cover is positionable over an article of furniture. A blanket is coupled to the cover. The blanket is positionable over a user when the user sits on or adjacent to the article of furniture to warm the user. Moreover, the blanket has a length and a width of at least 180.0 cm to accommodate a pair of users.

4 Claims, 5 Drawing Sheets

FURNITURE BLANKET ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to blanket devices and more particularly pertains to a new blanket device for covering one or more users sitting on or adjacent to an article of furniture.

BRIEF SUMMARY OF THE INVENTION

An embodiment of the disclosure meets the needs presented above by generally comprising a cover that is comprised of a deformable material and the cover is positionable over an article of furniture. A blanket is coupled to the cover. The blanket is positionable over a user when the user sits on or adjacent to the article of furniture to warm the user. Moreover, the blanket has a length and a width of at least 180.0 cm to accommodate a pair of users.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
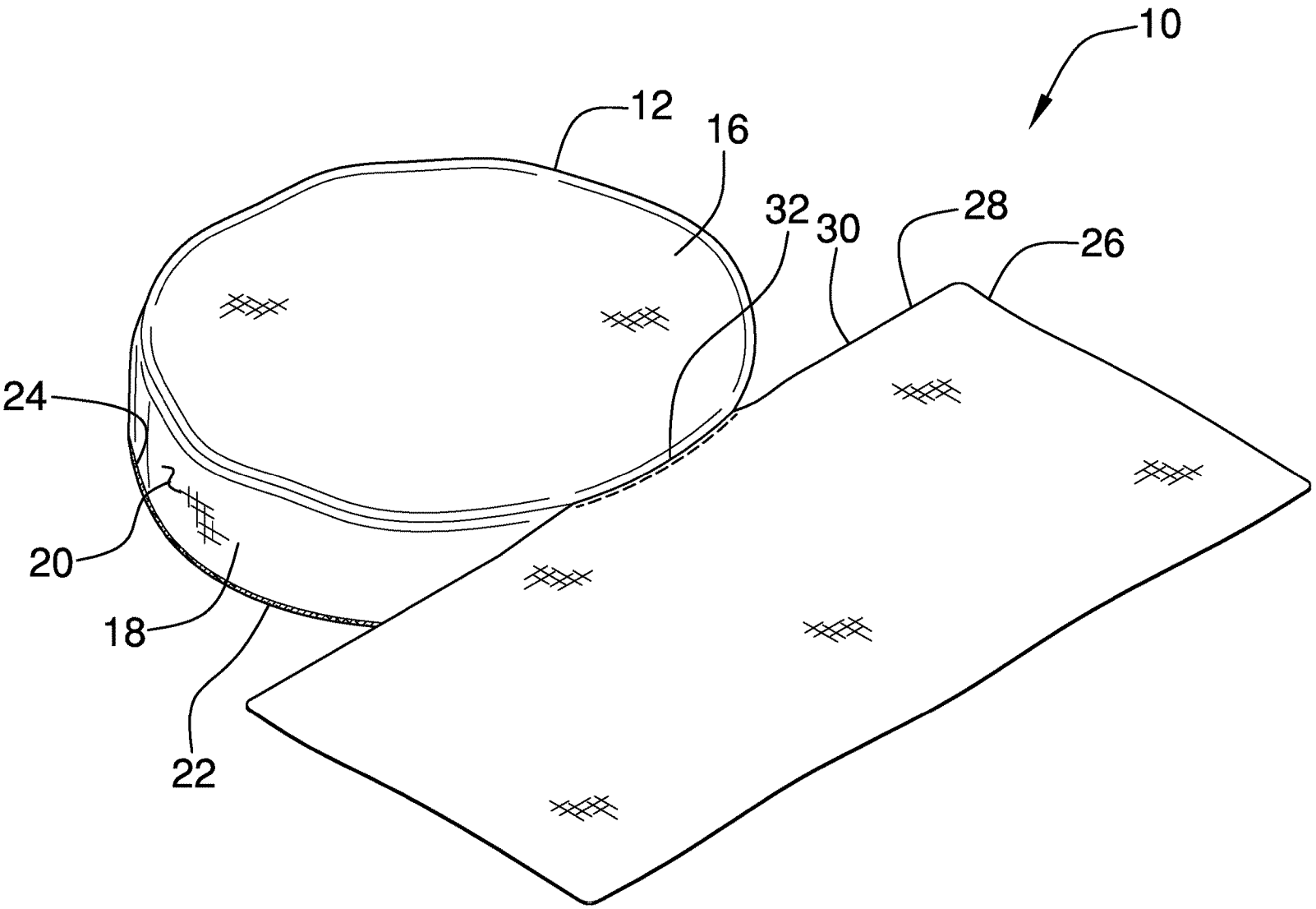
FIG. 1 is a top perspective view of a furniture blanket assembly according to an embodiment of the disclosure.
Figure 2:
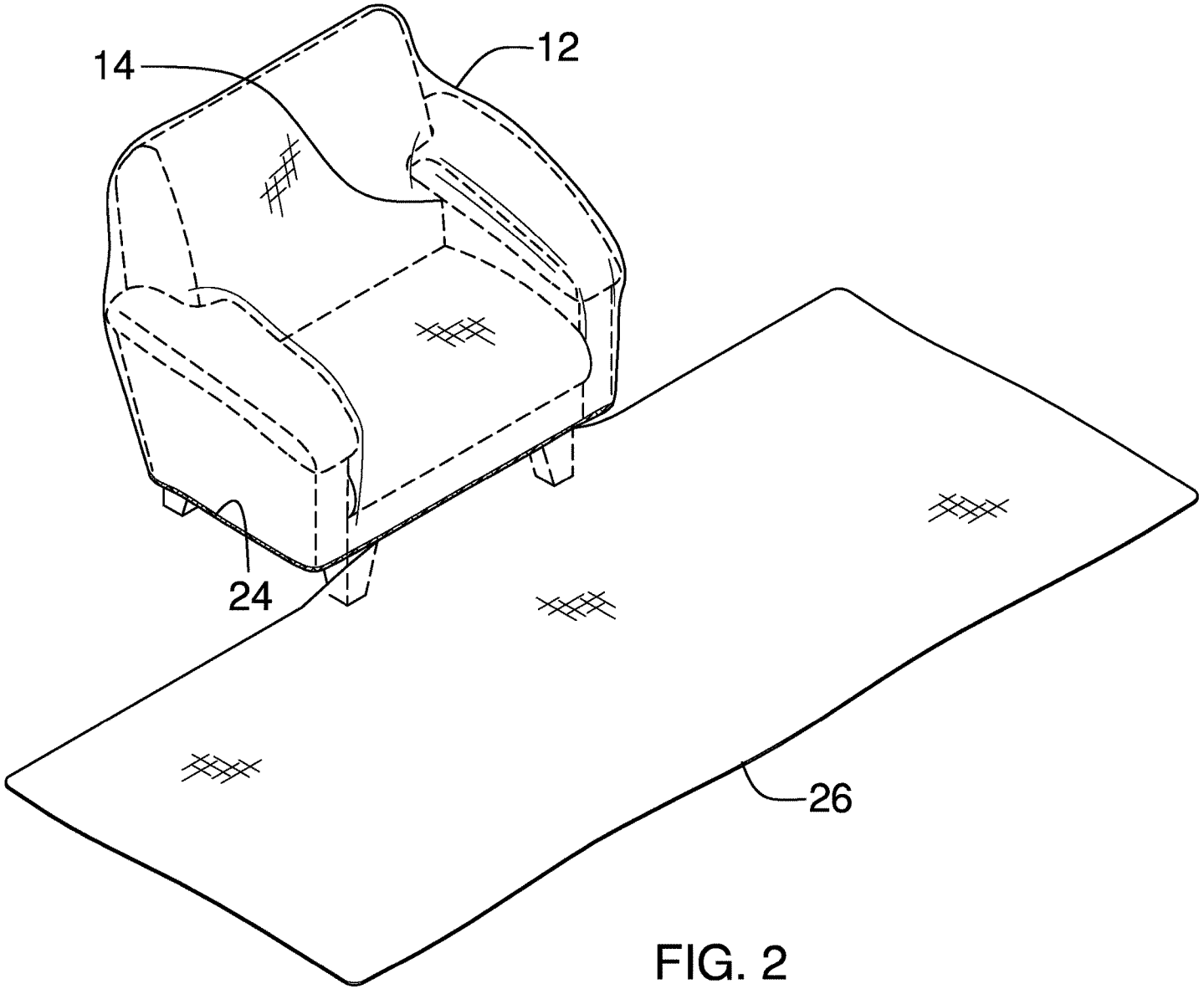
FIG. 2 is a phantom in-use view of an embodiment of the disclosure.
Figure 3:
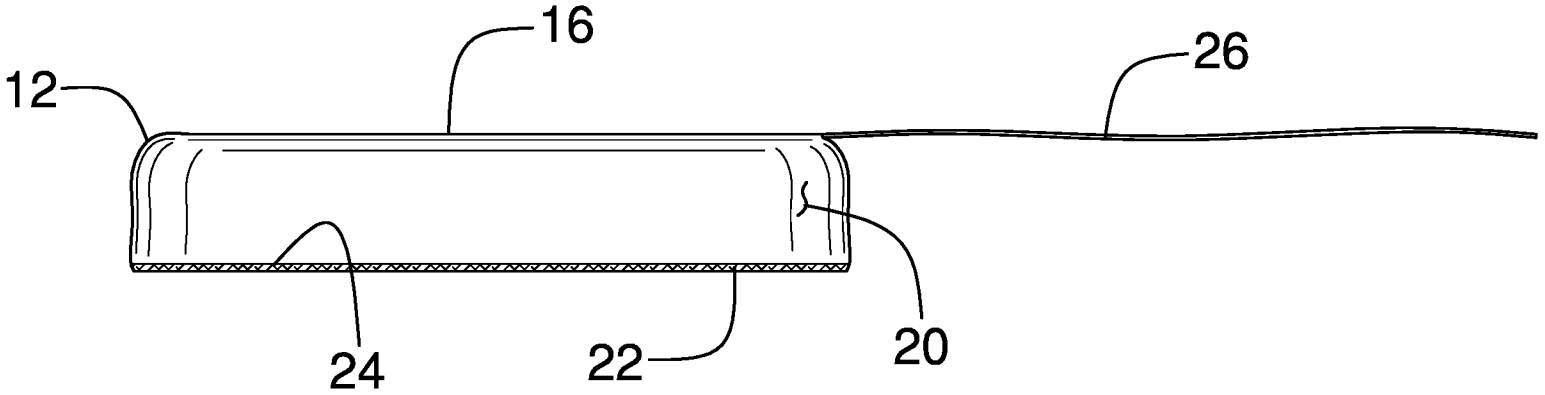
FIG. 3 is a right side view of an embodiment of the disclosure.
Figure 4:
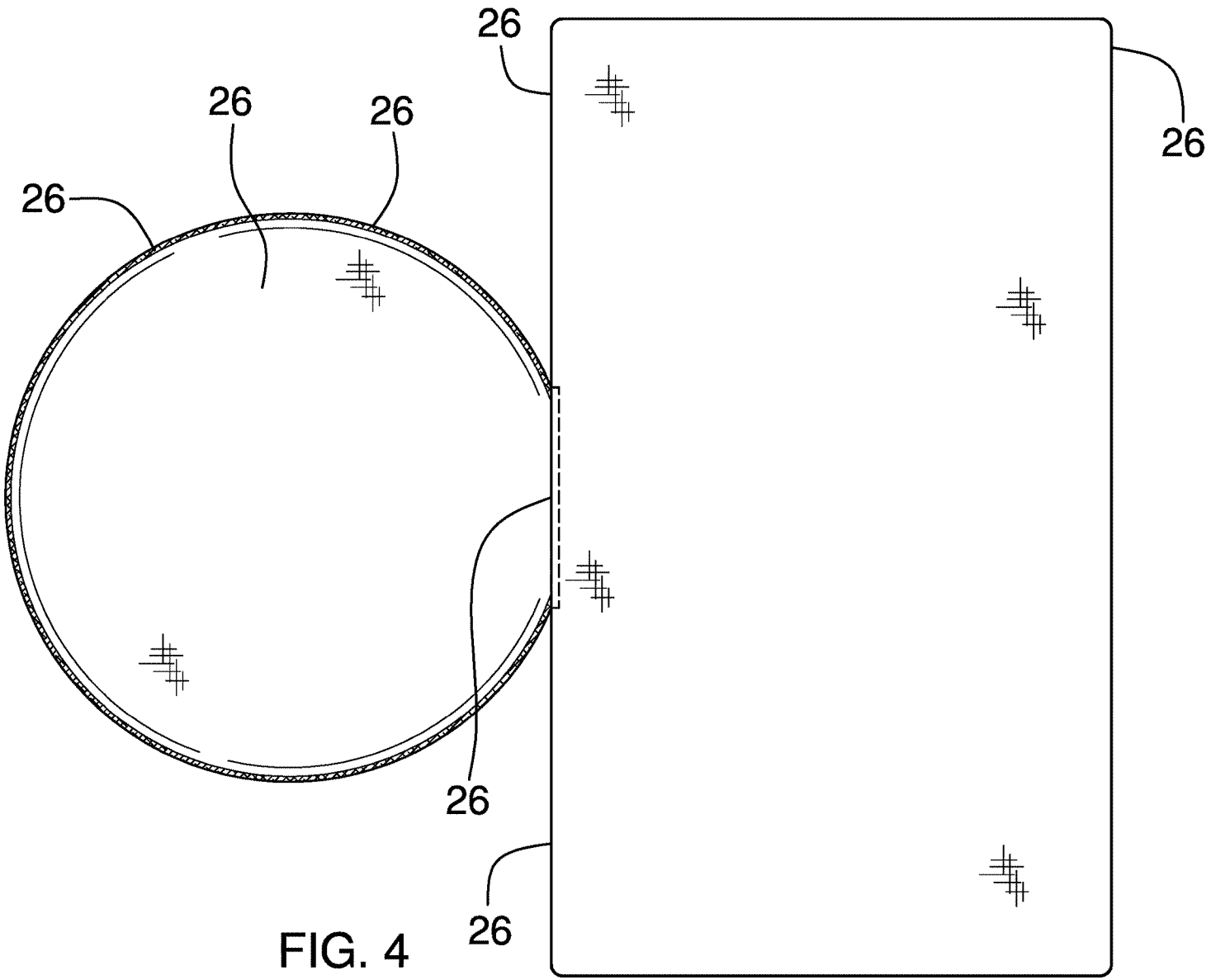
FIG. 4 is a bottom view of an embodiment of the disclosure.
Figure 5:
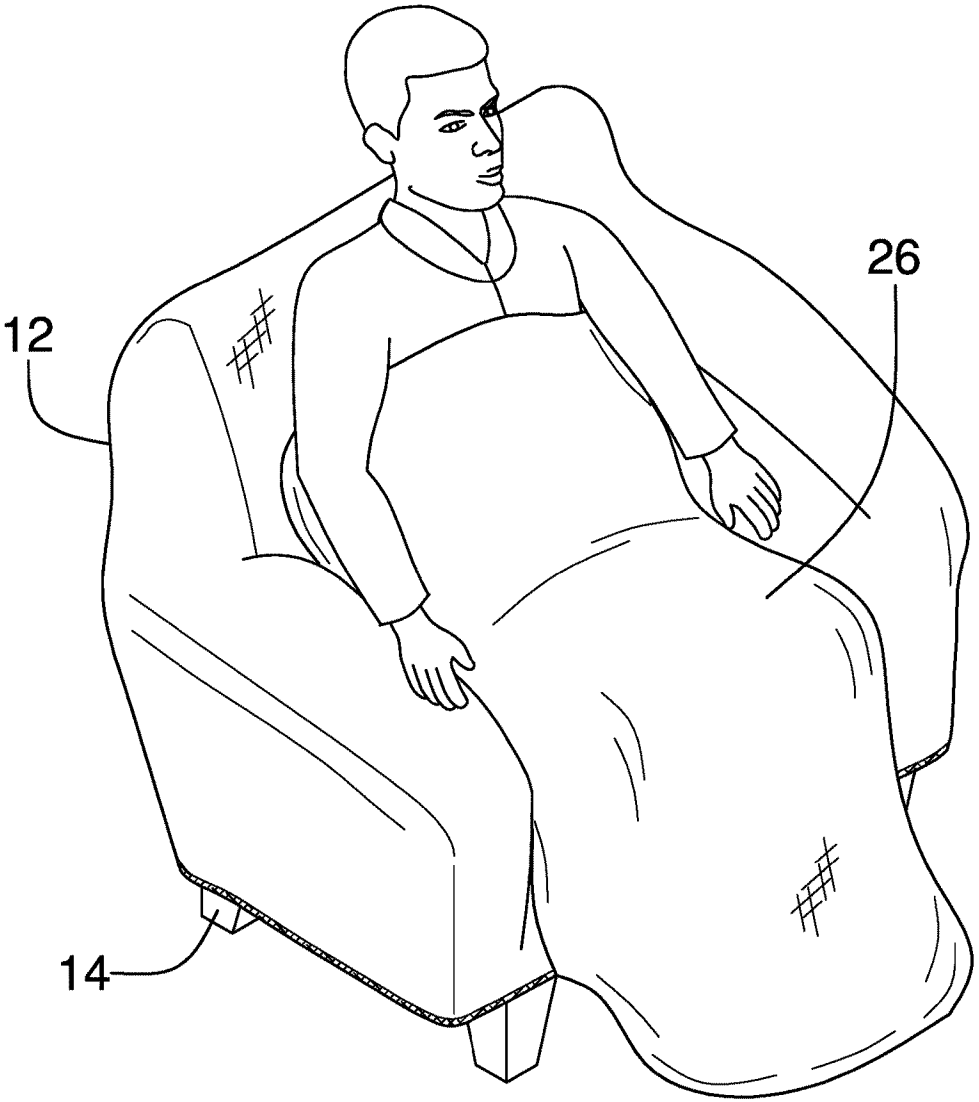
FIG. 5 is a perspective in-use view of an embodiment of the disclosure.

With reference now to the drawings, and in particular to FIGS. 1 through 5 thereof, a new blanket device embodying the principles and concepts of an embodiment of the disclosure and generally designated by the reference numeral 10 will be described.

As best illustrated in FIGS. 1 through 5, the furniture blanket assembly 10 generally comprises a cover 12 that is comprised of a deformable material thereby facilitating the cover 12 to be positionable over an article of furniture 14. The article of furniture 14 may be a chair, a sofa or any other article of furniture 14 for sitting. The cover 12 has a top wall 16 and an outer wall 18 extending downwardly therefrom, and the outer wall 18 is continuously acruate such that the cover 12 has a circular shape. The outer wall 18 has an outside surface 20 and a distal edge 22 with respect to the top wall 16. Moreover, the top wall 16 lies on the article of furniture 14 having the outer wall 18 extending downwardly on the article of furniture 14. The circular shape of the cover 12 allows the cover 12 to surround a variety of shapes of articles of furniture.

A mating member 24 is coupled to the cover 12 and the mating member 24 biases the cover 12 to frictionally engage the article of furniture 14. In this way the cover 12 is retained on the article of furniture 14. The mating member 24 is positioned on the outer wall 18, and the mating member 24 is aligned with and is coextensive with the distal edge 22. The mating member 24 biases the distal edge 22 to compress against the article of furniture 14. Additionally, the mating member 24 may include, but not be limited to, a resiliently stretchable band, a pair hook and loop fasteners or a plurality of hooks.

A blanket 26 is coupled to the cover 12 and the blanket 26 is positionable over a user when the user sits on or adjacent to the article of furniture 14. In this way the blanket 26 can warm the user while the user is sitting on or adjacent to the article of furniture 14. The blanket 26 has a length and a width of at least 180.0 cm. Thus, the blanket 26 can accommodate a pair of users without restricting movement of the users.

The blanket 26 has a perimeter edge 28 and the perimeter edge 28 has a back side 30. The back side 30 has a coupled section 32 that is coupled to the outside surface 20 of the outer wall 18 of the cover 12. Thus, the blanket 26 extends away from the cover 12 thereby facilitating the blanket 26 to be wrapped around the user. The coupled section 32 is aligned with an intersection between the outer wall 18 and the top wall 16 of the cover 12.

In use, the cover 12 is positioned over the article of furniture 14 when the user wishes to sit on or adjacent to the article of furniture 14 and be covered by the blanket 26. The user sits on or adjacent to the article of furniture 14 and the user wraps the blanket 26 around themselves. Moreover, the ample size of the blanket 26 facilitates a pair of users to easily share the blanket 26 without restricting each other's motion.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A furniture blanket assembly being configured to cover and article of furniture and serve as a blanket for at least one user, said assembly comprising:

a cover being comprised of a deformable material, said cover being positionable over an article of furniture, said cover having a top wall and an outer wall extending downwardly therefrom, said outer wall being continuously acruate such that said cover has a circular shape, said outer wall having an outside surface and a distal edge with respect to said top wall, said top wall lying on the article of furniture having said outer wall extending downwardly on the article of furniture;

a mating member being coupled to said cover, said mating member biasing said cover to frictionally engage the article of furniture thereby retaining said cover on the article of furniture, said mating member being positioned on said outer wall, said mating member being aligned with and being coextensive with said distal edge, said mating member biasing said distal edge to compress against the article of furniture; and a blanket being coupled to said cover, said blanket being positionable over a user when the user sits on or adjacent to the article of furniture wherein said blanket is configured to warm the user, said blanket having a length and a width of at least 180.0 cm wherein said blanket is configured to accommodate a pair of users, said blanket having a perimeter edge, said perimeter edge having a back side, said back side having a coupled section being coupled to said outer wall of said cover having said blanket extending away from said cover, said coupled section being aligned with an intersection between said outer wall and said top wall of said cover.

2. A furniture blanket assembly being configured to cover and article of furniture and serve as a blanket for at least one user, said assembly comprising:

a cover being comprised of a deformable material, said cover being positionable over an article of furniture;

a blanket being coupled to said cover, said blanket being positionable over a user when the user sits on or adjacent to the article of furniture wherein said blanket is configured to warm the user, said blanket having a length and a width of at least 180.0 cm wherein said blanket is configured to accommodate a pair of users; and wherein said cover has a top wall and an outer wall extending downwardly therefrom, said outer wall being continuously acruate such that said cover has a circular shape, said outer wall having an outside surface and a distal edge with respect to said top wall, said top wall lying on the article of furniture having said outer wall extending downwardly on the article of furniture.

3. The assembly according to claim 2, further comprising a mating member being coupled to said cover, said mating member biasing said cover to frictionally engage the article of furniture thereby retaining said cover on the article of furniture, said mating member being positioned on said outer wall, said mating member being aligned with and being coextensive with said distal edge, said mating member biasing said distal edge to compress against the article of furniture.

4. The assembly according to claim 2, wherein said blanket has a perimeter edge, said perimeter edge having a back side, said back side having a coupled section being coupled to said outer wall of said cover having said blanket extending away from said cover, said coupled section being aligned with an intersection between said outer wall and said top wall of said cover.

* * * * *